US005950823A

United States Patent [19]

Flis

[11] Patent Number: 5,950,823

[45] Date of Patent: Sep. 14, 1999

[54] GOLF CLUB HOLDER

[75] Inventor: Albert J. Flis, Strongsville, Ohio

[73] Assignee: Design Tool & Machine, Cleveland, Ohio

[21] Appl. No.: 08/342,759

[22] Filed: Nov. 21, 1994

[51] Int. Cl.[6] ..... A63B 55/00

[52] U.S. Cl. ..... 206/315.2; 206/315.3

[58] Field of Search ..... 206/315.2, 315.3, 206/315.6

[56] References Cited

U.S. PATENT DOCUMENTS

| | | | |
|---|---|---|---|
| 942,306 | 12/1909 | Clarke | 239/33 |
| 2,066,121 | 12/1936 | Morris | 239/33 |
| 2,815,981 | 12/1957 | Nonamaker et al. | 239/33 |
| 4,029,136 | 6/1977 | Jacoby | 206/315.3 X |
| 4,154,274 | 5/1979 | Adamson | 206/315.2 |
| 4,194,547 | 3/1980 | Sidor et al. . | |
| 4,200,131 | 4/1980 | Chitwood et al. | 206/315.6 |
| 4,332,283 | 6/1982 | Rader | 206/315.6 |
| 4,746,014 | 5/1988 | Very | 206/315.6 |
| 4,944,396 | 7/1990 | Larkin | 206/315.6 |
| 4,967,904 | 11/1990 | Quellais et al. | 239/33 |
| 5,103,974 | 4/1992 | Antonious . | |

*Primary Examiner*—Gary E. Elkins
*Assistant Examiner*—Tri M. Mai
*Attorney, Agent, or Firm*—Fay, Sharpe, Beall, Fagan, Minnich & McKee

[57] ABSTRACT

An inner tube is slidably received within an outer tube. A number of tube stops and a bias or spring means are associated with the tubes. The inner elongated tube has an inner diameter sufficiently large to store the shaft of a golf club, an outer diameter sufficiently small in size to be slidably received within the inner diameter of the outer elongated tube. The arrangement of the inner and outer tubes, as well as the stops and spring means, allows for the inner tube to rise above, or out of, the outer tube once the weight of the golf club is removed. Consequently, the arrangement can be utilized not only to protect and separate golf clubs in a golf bag, but also can be used for convenient insertion of a golf club in a golf bag and as an indicator to show that a golf club is removed from the golf bag. By raising the inner tube up and out of the outer tube, one can easily visualize that the club associated with the tube is missing from the bag.

6 Claims, 2 Drawing Sheets

GOLF CLUB HOLDER

BACKGROUND OF THE INVENTION

This invention relates to a device for protecting and separating golf clubs in a golf bag and for facilitating convenient insertion of a golf club in the golf bag. The device further serves as an indicator to a golfer that a golf club is removed from the golf bag. More particularly, the invention is directed to a device comprising an arrangement of two elongated cylindrical tubes, a plurality of which devices can be used in golf bags for separating and protecting golf clubs. An inner tube, having a spring disposed therearound, is positioned within an outer tube. The spring is retained between the cylindrical surfaces of the tubes with an arrangement of stops so that when a golf club is placed in the inner tube, the spring is compressed and the inner tube is slidably received within the outer tube. When the golf club is removed, the spring decompresses and partially ejects the inner tube from the outer tube. The ejected inner tube serves as a convenient guide for replacement of the golf club in the bag and as a reminder to the golfer that a golf club is missing from the bag.

While the invention is particularly directed to the art of golf club holders and will be thus described with specific reference thereto, it will be appreciated that the invention may have usefulness in other fields and applications.

A wide variety of golf club holding, separating, and/or protecting tubes are known. However, those known do not show the specific tube and spring relationship of the present invention.

For example, U.S. Pat. No. 4,746,014 to Very is directed to a tubular protective device for storing a golf club. The embodiments disclosed are adapted to rise above the level of the other tubes in the golf bag when the golf club is removed from the device. The Very patent does not, however, show a coiled spring wrapped about an inner tube positioned within an outer tube nor a series of stops arranged on and between the tubes to facilitate restricted relative motion between the tubes.

U.S. Pat. No. 4,200,131 to Chitwood et al. discloses a device for carrying golf clubs which includes a molded upper plate having individual holes for the handles and shafts of the clubs to be carried and having contoured surfaces coinciding with the loft angle of the clubs so that each club can be maintained with its striking face in contact with a mating surface while it is being transported in the device. The Chitwood et al. patent, however, does not show a tube that can be ejected from another tube by activation of a spring. The series of stops, effective to prevent over-ejection of tubes in the present invention, is not shown in the Chitwood et al. patent. Moreover, the Chitwood et al. patent provides no apparent means for indicating whether a club is removed from a bag, an objective of the present invention.

U.S. Pat. No. 4,029,136 to Jacoby shows a device which can be attached to a golf club bag which allows a user to select a particular club by elevating the desired club itself above the other clubs. This action aids in the removal of the club from the bag. While the Jacoby patent discloses a spring mechanism for ejecting a club to an elevation above other clubs, it does not show a tube within a tube arrangement nor does it show a spring means wrapped around one of the tubes. Additionally, it does not provide a specific stop arrangement nor a convenient indicator with respect to whether a club is contained in the golf bag.

U.S. Pat. No. 4,944,396 to Larkin teaches a device for indicating whether and from which location a club has been removed from a golf bag. The Larkin patent, though, does not show a spring mechanism nor a tube within a tube arrangement.

Finally, U.S. Pat. No. 5,103,974 to Antonious shows that a golf club holder insert having a compartment formed of a telescoping member is vertically adjustable with respect to a tube. The Antonious patent does not show a tube within a tube arrangement nor does it show that a tube can be raised, or ejected, by means of a spring.

SUMMARY OF THE INVENTION

An object of the present invention is to provide a golf club holder which facilitates convenient insertion of a golf club therein.

A further object of the invention is to provide a golf club holder which serves as an indicator to a golfer that a golf club is removed from the golf bag.

A further object of the invention is to provide a golf club holder to protect and separate golf clubs in a golf bag.

The above objects can be achieved in the present invention by providing an inner tube which is slidably received within an outer tube, a number of tube stops, and a bias or spring means. The inner elongated tube has an inner diameter sufficiently large to store the shaft of a golf club and an outer diameter sufficiently small in size to be slidably received within the inner diameter of the outer elongated tube. The arrangement of the inner and outer tubes, as well as the stops and spring means, allows for the inner tube to rise above, or out of, the external protective tube once the weight of the golf club is removed. Consequently, this invention can be utilized not only to protect and separate golf clubs in a golf bag, but also can be used for convenient insertion of a golf club therein and as an indicator to show that a golf club is missing from the golf bag. By raising the inner tube up and out of the external tube, one can easily visualize that the club associated with the tube is missing from the bag.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention consists in the construction, arrangement, and combination, of the various parts of the device, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

Figure 1B:
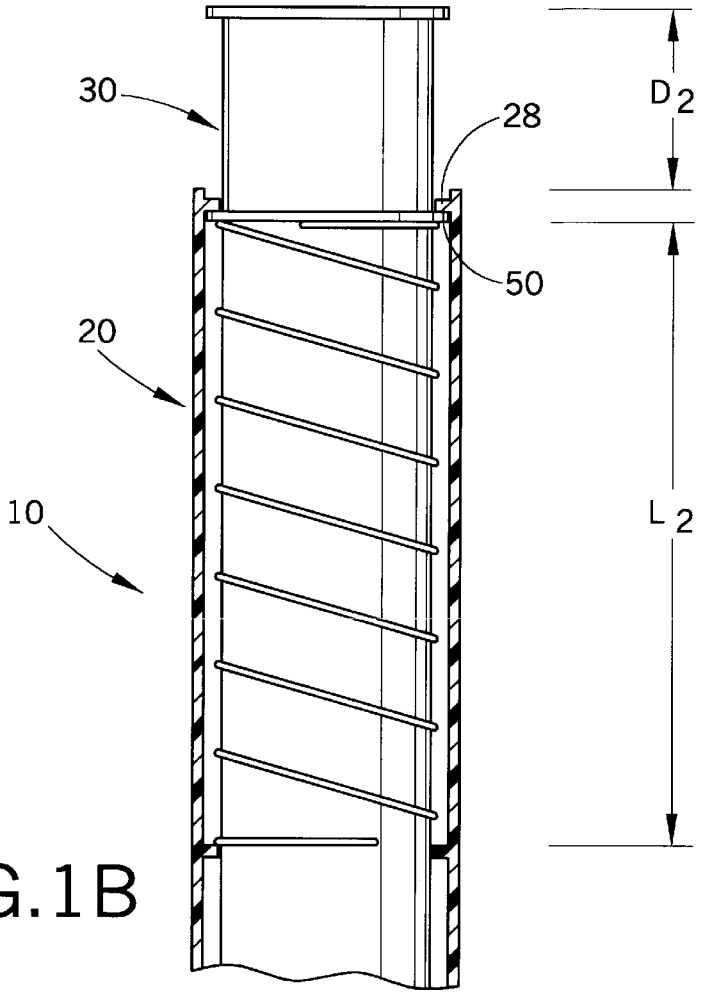
FIG. 1B is a partial elevational view with selected portions shown in cross-section of the golf club holder of FIG. 1A in a partially ejected state.
Figure 1A:
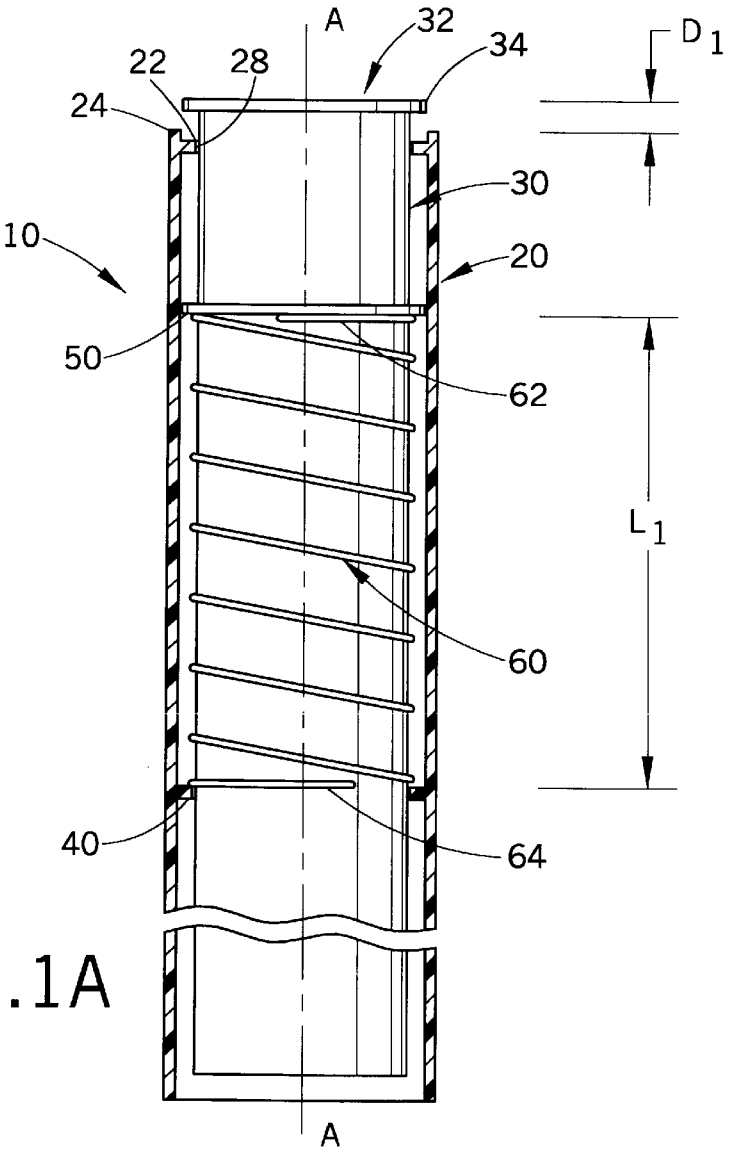
FIG. 1A is an elevational view with selected portions shown in cross-section of a golf club holder in a compressed state.

Referring now to the drawings wherein the showings are for purposes of illustrating the preferred embodiments and not for purposes of limiting same, FIGS. 1A and B provide elevational views with selected portions shown in cross-section of the preferred embodiment. As shown, the golf club holder 10 is comprised of an outer tube or elongated plastic cylinder 20, an inner tube or elongated plastic cylinder 30, and a spring mechanism, or spring 60. Stops 28, 40, 50 are associated with outer tube 20 and inner tube 30 to facilitate positioning of spring 60 and restrict relative movement of inner tube 30 with respect to outer tube 20.

Tubes 20, 30 are preferably formed of hard plastic. However, any material of sufficient strength to facilitate retention of golf clubs is acceptable. Moreover, spring 60 is preferably of a compressible, resilient metal or plastic material.

Figure 3:
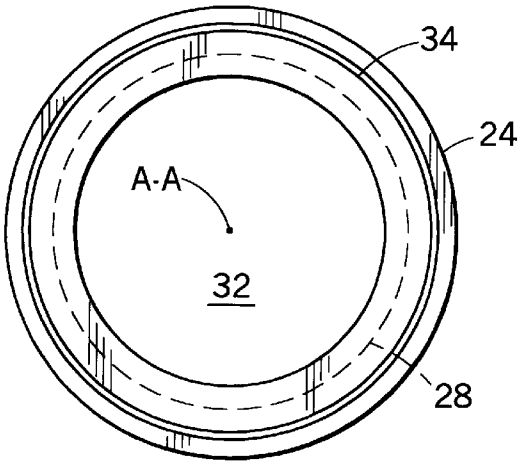

Referring now specifically to FIGS. 1A and 3, outer tube 20 has an open end 22 and an end portion 24 circumferentially disposed about open end 22. End portion 24 includes a stop 28 extending radially inwardly to the longitudinal axis A—A of the arrangement. Stop 28 may be a series of projections, or a collar, formed by any known welding, molding, or fitting process.

Referring back now to FIGS. 1A and B, outer tube 20 is further provided with a stop 40 disposed on an inner surface of outer tube 20 and spaced from stop 28 of end portion 24. Stop 40 may be a series of projections extending radially inwardly to the longitudinal axis A—A, or a collar, formed by any known welding, molding or fitting process.

Inner tube 30, which preferably has a diameter slightly less than that of outer tube 20, has an open end 32 and a collar 34 circumferentially disposed thereon. Open end 32 should be of sufficient size to receive a golf club handle and shaft. Collar 34 extends radially outwardly from longitudinal axis A—A, as also shown in FIG. 3. Collar 34 can be formed via any known welding, molding or fitting process.

Inner tube 30 is further provided with a stop 50 disposed on an outer surface of inner tube 30, spaced from collar 34 and extending radially outwardly of the longitudinal axis A—A. Similar to the other stops in the arrangement, stop 50 may be a series of projections, or a collar, formed by any known welding, molding or fitting process. The distance that stop 50 is spaced from the collar 34 is less than the distance from stop 28 to stop 40 of outer tube 20 and corresponds to the distance that inner tube 30 will ultimately be projected from outer tube 20 when a golf club is removed therefrom.

It is preferred that the respective sizes, i.e., radial projection length from the surface from which the stop originates, for all stops be equal. Such an arrangement allows each stop to engage a corresponding opposing surface. For example, stops 28, 40 and 50 are all of equal radial projection length. Consequently, stop 40 and stop 28 engage the outer surface of inner tube 30 and stop 50 engages the inner surface of outer tube 20. A further advantage of this arrangement is that spring 60 can be retained in golf club holder 10 between the cylindrical surfaces of the tubes 20, 30, as described above, in a convenient manner.

Additionally, it is preferred that at least inner tube 30 have a bottom opposite its open end 32. Such bottom will facilitate retention of the golf club therein. It is recognized that a strap or partial bottom could be used, or even an interference fit between the club handle and the inner tube 30 in lieu of any bottom at all. It is further recognized that a bottom is not essential for outer tube 20 since the club is only retained in the inner tube 30.

Spring 60 has an uppermost coil 62 and a lowermost coil 64. Spring 60 is preferably of a strength sufficient to partially eject inner tube 30 from outer tube 20 when a golf club is removed from inner tube 30. Spring 60, however, is not of a strength so as to prevent compression of spring 60 when the golf club is inserted in inner tube 30. It is also appreciated that while a spring mechanism is preferred, any type of resilient bias means would achieve the objectives of the present invention.

In operation, golf club holder 10 can be used to separate and protect golf clubs and facilitate convenient insertion of golf clubs to a golf bag, particularly when a plurality of such holders 10 are placed therein. Golf club holder 10, when in a partially ejected state, also serves as a reminder to the golfer that a golf club is missing from the golf bag.

Specifically, inner tube 30 is positioned within the outer tube 20 so that stop 28 of outer tube 20 is engaging the outer surface of inner tube 30 between stop 50 and collar 34. Necessarily, then, stop 50 is disposed between stop 28 and stop 40.

Spring 60 is positioned between the stops 40, 50 so that uppermost coil 62 engages stop 50 and lowermost coil 64 engages stop 40. Thus, spring 60 is retained longitudinally with respect to axis A—A between stops 40 and 50 and radially with respect to axis A—A between inner tube 30 and outer tube 20.

Figure 2B:
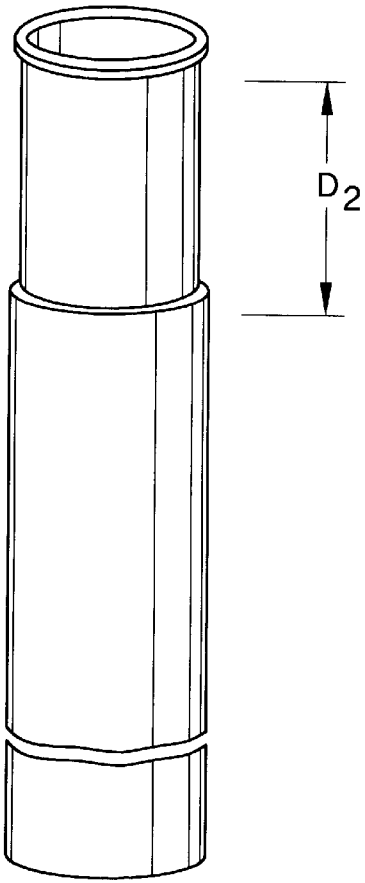
FIG. 2B is a partial elevational view of the golf club holder of FIG. 1A with the golf club removed therefrom; and, FIG. 3 is a top elevational view of the golf club holder of FIG. 1A.
Figure 2A:
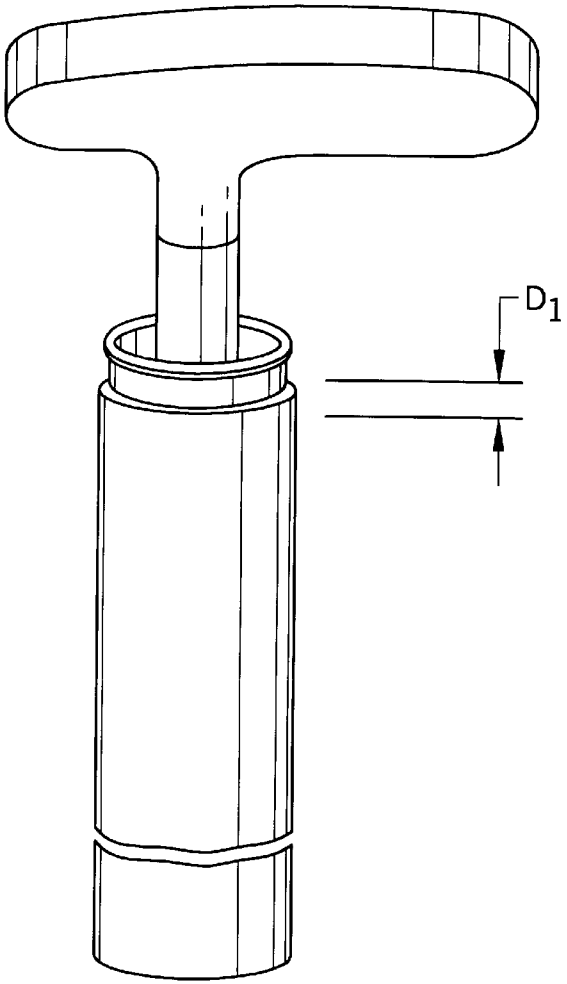
FIG. 2A is an elevational view of the golf club holder of FIG. 1A with a golf club inserted therein.

As shown in FIGS. 1A and 2A, when a golf club is inserted into inner tube 30, spring 60 is compressed to a length $L_1$. The end result is that inner tube 30 is projected only a distance $D_1$ from outer tube 20.

FIGS. 1B and 2B show that removal of the club from inner tube 30 allows spring 60 to decompress and extend to a length $L_2$. Consequently, inner tube 30 is partially ejected from outer tube 20 by the restoration force of spring 60 to a distance $D_2$.

It is understood that the engagement of stop 50 to stop 28 prevents inner tube 30 from being completely ejected from outer tube 20. However, spring 60 could be of a force such that removal of a golf club from inner tube 30 would only eject the tube 30 a distance $D_2 - D_1$ thus obviating the need for stop 28. Moreover, the force of spring 60 in a compressed state, along with the stop arrangement, prevents inner tube 30 from being completely received in outer tube 20.

The construction of golf club holder 10 includes first forming stop 40 in outer tube 20 by any known method. For example, one might spot weld on the outer surface of outer tube 20 at a series of circumferentially disposed locations, thus forming inward projections, or stops, on the inner surface. Similarly, a collar may serve as a stop 40. The collar could be molded, welded, or attached by any known process therein. The stop 50 should then be formed by a similar process.

It is recognized that while each of the stops could be either a series of projections or a collar, it is preferred that at least stop 50 be a collar. This arrangement eliminates the chance that inner tube 30 would be inadvertently ejected from outer tube 20, as might be the case if both stops 28 and 50 were a series of projections. Of course, it is conceivable that such chance of ejection could also be eliminated in the case of both stops 28 and 50 being a series of projections if the respective series of projections of stops 28 and 50 were properly sized.

The spring 60 is then placed around the inner tube 30 so that uppermost coil 62 engages stop 50. The inner tube 30 should be inserted into open end 22 of outer tube 20 so that lowermost coil 64 engages stop 40.

Last, stop 28 is formed to prevent complete ejection of inner tube 30 from outer tube 20 when a golf club is removed. As with the other stops, the stop 28 may be either a series of inward projections or a collar.

It is recognized that the stop arrangement noted above could be modified to include an interference fit in lieu of stop 28. An interference fit in this instance would achieve the objectives of the present invention.

It is appreciated that alternative embodiments satisfying the objectives of the invention may be constructed. For example, a similar device may be constructed without stops 28 and 50. Accordingly, spring 60 would then be positioned between collar 34 and stop 40. When in the ejected state, spring 60 would be exposed.

Another alternative embodiment may include a bottom, or closed end, for outer tube 20. Such closed end could replace stop 40 as a means for engaging lowermost coil 64. Thus, spring 60 would extend substantially along the whole length of the arrangement. Obviously, the strength of spring 60 would have to be suitably adjusted. This arrangement would fall within the scope of the invention whether the stops 28 and 50 were present or not.

A still further alternative may dispose spring 60 between and attached to stops 28 and 50, obviating the need for stop 40. In this embodiment, insertion of a golf club in inner tube 30 would result in decompression, and extension, of spring 60. Accordingly, removal of a golf club from the arrangement would result in compression of spring 60 to eject inner tube 30 from outer tube 20. Of course, a variety of stop arrangements could be used and spring 60 would need to be of sufficient resiliency to withstand the force of the weight of a golf club for extended periods of time and still eject the inner tube 30 upon removal of such golf club.

When properly constructed, the golf club holder 10 can be used, along with a plurality of other golf club holders, to protect and separate golf clubs in a golf bag. The unique characteristics of the golf club holder 10 allow it to facilitate convenient insertion of golf clubs therein since the inner tube 30 is projected above all other golf club tubes containing golf clubs. Moreover, when a golf club is removed, the corresponding partially ejected inner tube 30 serves as an indicator that the golf club is removed since the partially ejected inner tube 30 is projected above other tubes 10.

As an aside, a numeric designation in the form of a sticker or the like corresponding to a golf club number could be placed on the inner tube 30 just below collar 34. Such designation would serve as an indication to the golfer that a specific golf club is removed from the bag.

The above description merely provides a disclosure of the particular embodiments of the invention and is not intended for purposes of limiting the same thereto. As such, the invention is not limited to only the above described embodiments. Rather, it is recognized that one skilled in the art could conceive alternative embodiments that fall within the scope of the invention.

Having thus described the invention, I claim:

1. A golf club holder comprising:

a first elongated cylinder having an inner surface terminating in an open end thereof;

a first stop on the inner surface spaced from the open end;

a second elongated cylinder having an outer surface slidably received in the first elongated cylinder;

a second stop on the outer surface of the second elongated cylinder; and, a spring mechanism between the inner surface of the first cylinder and the outer surface of the second cylinder and between the first stop and the second stop.

2. The holder of claim 1 wherein the second stop is a collar about an open end of the second elongated cylinder.

3. A golf club holder comprising:

a first elongated cylinder having a longitudinal axis and an inner surface terminating in an open end thereof;

a first stop on the inner surface longitudinally spaced from the open end and extending radially inwardly;

a second elongated cylinder having an outer surface slidably received in the first elongated cylinder along the longitudinal axis;

a second stop on the outer surface of the second elongated cylinder extending radially outwardly; and, a spring mechanism radially between the inner surface of the first cylinder and the outer surface of the second cylinder and longitudinally between the first stop and the second stop.

4. The holder of claim 3 wherein the second stop is a collar about an open end of the second elongated cylinder.

5. A golf club holding comprising:

a first tube having an inner circumferential surface, an open end, a first stop projecting radially inwardly and disposed generally about the open end, and a second stop on the inner circumferential surface spaced from the first stop;

a second tube in the first tube, the second tube having an outer circumferential surface and a third stop on the outer circumferential surface, the third stop being positioned between the first stop and the second stop; and, a spring mechanism around the second tube and between the second stop and the third stop.

6. A golf club holder comprising:

a first elongated cylinder having a longitudinal axis, an inner surface, and a closed end;

a second elongated cylinder having an open end and an outer surface slidably received in the first elongated cylinder along the longitudinal axis;

a stop spaced from the open end on the outer surface extending radially outwardly; and, a spring radially between the inner surface of the first elongated cylinder and the second elongated cylinder and longitudinally between the stop and the closed end.

* * * * *